United States Patent [19]

Sund et al.

[11] 3,935,362

[45] Jan. 27, 1976

[54] IMAGE CONTROL MEANS AND STRUCTURED TRANSFER SHEET FOR THERMAL REPRODUCTION PROCESSES

[75] Inventors: Joseph Tat-Hin Sund, Los Angeles; Yoshikazu Yamada, Irvine, both of Calif.

[73] Assignee: Bell & Howell Company, Chicago, Ill.

[22] Filed: Oct. 25, 1973

[21] Appl. No.: 409,531

[52] U.S. Cl. ..... 428/207; 428/484; 428/913

[51] Int. Cl.[2]..... B41M 5/10; B41M 5/18

[58] Field of Search ..... 117/36.8, 38, 36.9, 36.4; 101/453; 428/207, 484, 913

[56] References Cited

UNITED STATES PATENTS

| | | | |
|---|---|---|---|
| 3,181,965 | 5/1965 | Michelotti | 117/36.7 |
| 3,476,937 | 11/1969 | Vrancken | 117/36.1 |
| 3,706,276 | 12/1972 | Yamada et al. | 117/36.4 X |
| 3,717,093 | 2/1973 | Bruck | 117/36.8 |

*Primary Examiner*—Thomas J. Herbert, Jr.
*Attorney, Agent, or Firm*—Nilsson, Robbins, Bissell, Dalgarn & Berliner

[57] ABSTRACT

A transfer sheet for thermal reproduction processes having a discontinuous transfer layer defined by a plurality of closely spaced discrete carbon regions. In a specific embodiment the transfer surface is defined by a substantially uniform distribution of carbon regions of varying diameters providing improved continuous tone reproduction through temperature-correlated carbon transfer.

7 Claims, 4 Drawing Figures

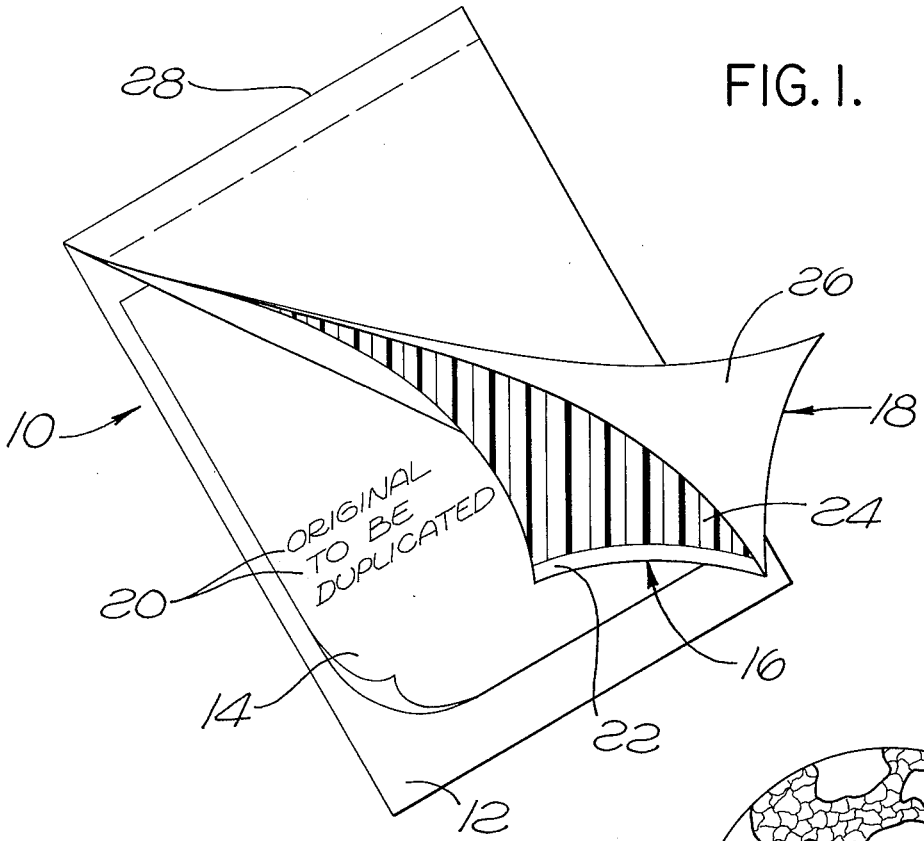
FIG. 1.
FIG. 2.
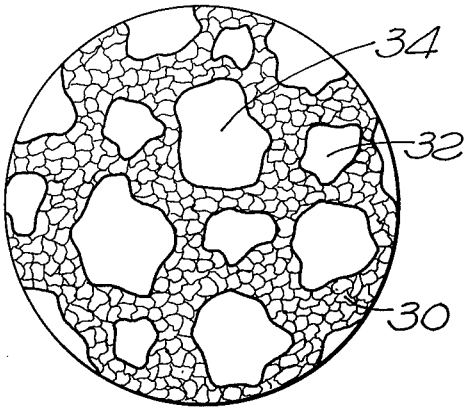
FIG. 3.
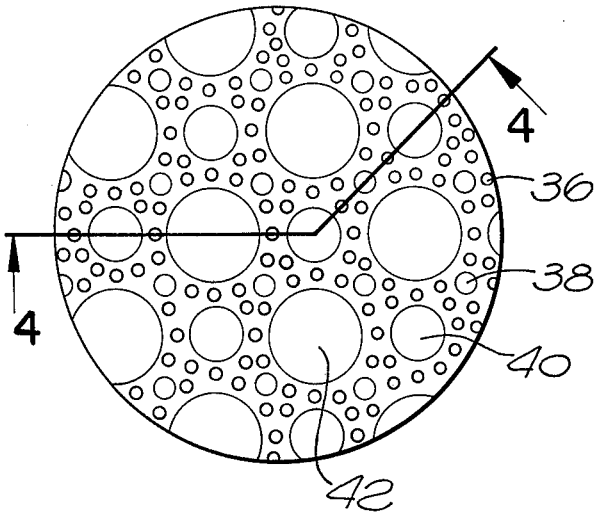
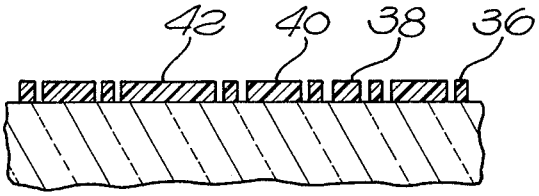
FIG. 4.

IMAGE CONTROL MEANS AND STRUCTURED TRANSFER SHEET FOR THERMAL REPRODUCTION PROCESSES

FIELD OF THE INVENTION

The present invention generally relates to image duplicating and more particularly to thermal duplicating processes and improved transfer sheets for use therein.

BACKGROUND AND SUMMARY OF THE INVENTION

Various types of thermal duplicating processes, that is, processes which involve the thermal transfer of heat-sensitive material, are well known in the art. See, for example, those processes described in U.S. Pat. Nos. 3,122,997 and 3,122,998 issued to Raczynski et al., as well as U.S. Pat. Nos. 1,514,677, 2,501,445, 2,611,313, 2,808,777, 2,939,099, 3,809,748, 3,181,965, 3,260,603, 3,262,386, 3,267,848, 3,283,708 3,293,055, 3,304,015, 3,384,015 and our U.S. Pat. No. 3,706,276. As further background hereto, reference may also be made to U.S. Pat. Nos. 2,191,514, 2,398,779, 2,408,147, Re. 24,899, 3,010,390, 3,458,336 and 3,476,937.

Typically, an original to be duplicated is placed in an assembly with a transfer sheet substrate carrying a fusible layer of heat sensitive material and an image-receiving sheet which has its receiving surface in contact with the layer of fusible material. The position and facing of the original document sheet relative to the transfer and receiving sheets can be varied depending upon whether a right-reading or a laterally reverse reading image is desired on the image receiving sheet. The image on the original document must be defined by an infrared absorptive material such as carbon, heavy metal, or certain organic compounds so that the image areas of the original document, upon exposure, will absorb more infrared radiation than the surrounding, non-image areas. The absorbed infrared radiation is converted to thermal energy forming a thermal pattern in the original document which corresponds to the visible image pattern. This heat pattern is conducted through the substrate of the transfer sheet to the heat sensitive layer. The heat sensitive layer is selectively fused in correspondence to the image and the fused material is transferred to the image-receiving sheet.

Following image transfer, depending upon the manner of placement of the original document, the image-receiving sheet may serve as a facsimile copy of the original document or it may be utilized as a master in a solvent duplicating or lithographic printing process. The heat-sensitive layer of the transfer sheet should contain, in addition to the fusible material, the necessary components for the ultimate application of the transferred image. For example, in spirit duplication processes, the heat-sensitive layer contains wax, or other fusible substance, mixed with an alcohol soluble dye (the combination being known to the art as "carbon") to produce the image color in the ultimate copy. The waxy material is thermally transferred in reverse reading fashion to the image-receiving sheet, normally referred to as a master. The master is placed on the drum of a duplicating machine and contacted with a succession of sheets of copy paper previously wet with a volatile alcohol solvent for the dye. The solvent dissolves part of the dye in the master image and transfers it to the copy paper. In another type of solvent duplicating process, the transferred image material contains a chemical reagent which reacts with a second reagent on the copy paper to yield a color. The second reagent may be originally in the copy paper or it may be delivered to the paper in duplicator fluid applied prior to contact with the master sheet. In offset lithographic printing, the material transferred to the image-receiving sheet, normally referred to as a printing plate, defines a right-reading image. If a reverse-reading image is initially prepared on an image-receiving sheet, it can be transferred to a direct image lithographic plate by contacting the thermally produced image with the face of the lithoplate and heating, as known to the art.

Thermal image transfer processes are relatively inexpensive, and effective in terms of color density when reproducing high contrast originals. However, such processes are generally not suitable for reproducing continuous tones as are found in silver photographic prints. When such an original is used for thermal reproduction with presently available carbon transfer processes, high contrast copies are produced which lack intermediate tones.

The present invention enables the production of continuous tone thermal copies. In particular, we provide a thermal transfer sheet having a discontinuous transfer layer defined by a plurality of closely spaced but discrete carbon regions which serve to "break" the image up into a plurality of image regions. In a specific embodiment, there is a substantially uniform distribution of carbon regions of varying diameters which provide continuous tone reproduction through temperature-correlated carbon transfer, as referred to in more detail hereinafter.

BRIEF DESCRIPTION OF THE DRAWINGS

FIG. 1 is a perspective view of a master sheet-transfer sheet-original document thermal transfer assembly;

FIG. 2 is a schematic detail of a portion of the surface of one type of transfer sheet herein;

FIG. 3 is a schematic detail of a portion of the surface of another type of transfer sheet herein; and FIG. 4 is a schematic cross-sectional view of a portion of the surface of the transfer sheet of FIG. 3, taken along the lines 4—4 of FIG. 3.

DETAILED DESCRIPTION

As required, detailed illustrative embodiments of the invention are disclosed herein. However, it is to be understood that these embodiments merely exemplify the invention which may take many forms radically different from the specific illustrative embodiments disclosed. Therefore, specific structural and functional details are not to be interpreted as limiting, but merely as a basis for the claims which define the scope of the invention. Somewhat in this regard, the illustrative embodiments herein comprise transfer sheets which are used in the transfer step of a spirit duplicating process. However, as hereinbefore indicated, the concepts and embodiments of this invention can be utilized in other solvent type duplicating process, such as the type involving a chemical reaction, or with lithographic printing processes and the like.

Referring to FIG. 1, a "sandwich" assembly 10 is illustrated which includes a base sheet 12 of relatively thick paper and which supports an original document 14 to be duplicated, a transfer sheet 16 and an image-receiving, master sheet 18. The original document 14 contains continuous tone infrared-absorptive indicia or images 20 on its face and is placed face-up on the base sheet 12, beneath the relatively thin transfer sheet 16. The transfer sheet 16 includes a plastic substrate 22 which carries a thin layer of heat-sensitive material 24 on the side opposite the original document 14. The master sheet 18 is disposed with its image-receiving surface 26 adjacent the transfer sheet layer 24 of heat-sensitive material. The top edges of the transfer sheet 16 and master sheet 18 are secured by adhesive or the like to the top edge 28 of the base sheet 12.

The heat sensitive material constituting the transfer layer 24 is commonly called "carbon" although elemental carbon is not usually a component thereof. In spirit duplication processes, the carbon comprises a combination of wax and dye. Waxes such as carnauba wax, bees wax, spermacetti wax and the like are used in various combinations with one or more dyes such as crystal violet, methyl violet, fuchsine dyes, magenta dyes, anthraquinone dyes, aniline dyes, azo dyes and the like. Other thermal processes involve a chemical reaction or utilize other materials. The particular chemical nature of the material is not a part of the present invention but all of the foregoing materials, and including those described in the above Raczyinski et al. patents, are meant to be included by the term "carbon" or "transfer material" as used herein. The carbon is formed on the transfer sheet substrate 22 as a pattern of discrete regions as hereinafter described.

The transfer sheet substrate 22 can be formed of any material usually employed for that purpose including Mylar (a transparent, tensilized polyethylene glycol terephthalate polyester film) which is sufficiently thin, about 0.5 mil, to avoid significant attenuation of the conducted heat pattern.

In use, the usual procedure is followed wherein the assembly 10 of base sheet 12, original document 14, transfer sheet 16 and master sheet is sandwiched together under pressure so that directly opposing surfaces are contiguous with one another. The assembly 10 is then exposed to radiations rich in infrared, directed onto the master sheet 18 so as to penetrate the master sheet 18 and transfer sheet 16 and impinge onto the original document 14. The radiation generates a temperature rise in the image portions of the document 14 resulting in a thermal pattern emanating from the document 14. As a result, the heat-sensitive carbon 24 is selectively fused to a softened condition in regions corresponding to the indicia 20 and is then transferred to the master sheet surface 26 to produce an image which corresponds to the indicia 20 on the original document 14. The imaged master 18 may then be removed from the assembly 10 and used as the copy or as a master for further reproduction in accordance with usual spirit reproduction techniques.

Referring additionally to FIG. 2, there is shown a schematic detail of the surface 24 of the transfer sheet 16. In accordance with the present invention, the transfer sheet surface 24 is discontinuous and defined by a plurality of closely spaced but discrete carbon regions, such as indicated by the numerals 30, 32 and 34. Any pattern of discontinuity is contemplated in the broader form of the present invention, the discontinuity serving to "break" up the thermal image into a plurality of image regions.

In a specific embodiment, as shown, the carbon regions 30, 32 and 34 are of varying widths or diameters substantially uniformly distributed over the transfer sheet substrate, the regions 30 being smaller than the regions 32, which, in turn, are smaller than the regions 34. Such variation in diameters provides continuous tone reproduction through temperature-correlated carbon transfer; i.e., carbon fusion (and, therefore, transfer) is correlated with tonal density of the original image. Accordingly, when a continuous tone original image, such as a silver photographic print, is exposed to infrared radiation, the tonal areas are heated according to their optical densities so that dark areas become hotter than light areas. When in contact with the present transfer sheet, under appropriate thermal conditions, heat from light tonal areas causes transfer of carbon material only from the smaller carbon regions, e.g. at 30. Areas of higher optical density generate higher temperatures and causes transfer of carbon material from the larger carbon regions 32 and, if dense enough, 34, as well as from the smaller regions 30. Thus, for the most dense or hottest image areas, transfer of carbon takes place from all carbon regions, producing the heaviest image; for lighter image areas only a partial transfer of carbon takes place. By responding to variations in amount of heat received, the transfer sheet provides more accurate reproductions of continuous tone images.

Generally, the transfer sheet will be coated so as to provide a size distribution (average diameter of carbon region) of about 1 to about 30 microns. About 25–75% of the total surface area of the transfer material can be constituted by carbon regions having an average diameter of about 11–30 microns, the remainder having average diameters of about 1–10 microns. The distance between carbon regions can vary from about 0.1 micron to about 30 microns.

A variety of techniques can be usd to form the discontinuous carbon surface. In one method, yielding the surface of FIG. 2, a thin uniform layer of polymer solution is spread over a smooth Mylar substrate and drying thereof is controlled so that instead of a smooth film layer, a reticulated surface is produced wherein the surface of the sheet is composed of cells of various sizes within the foregoing range and distribution. The reticulated surface can then be contacted with the carbon surface of a standard thermal carbon sheet, such as sold by Bell and Howell Company under the trademark "Ditto". Upon heating to fusion, the cells of the reticulated sheet are filled with the transfer material to form the transfer sheet of FIG. 2.

Details of formation of a reticulated surface as above described can be found in our U.S. Pat. No. 3,706,276. The extent of reticulation can be controlled by choice of polymer, solvent, diluent and drying conditions.

Generally, as polymer, one can use any organic polymeric material which is commonly used to form thin films, such as polyvinyl chloride, ethyl cellulose, polystyrene, chlorinated rubber, polymethylmethacrylate, cellulose acetate, polyvinylidene polymers, cellulose nitrate, condensation resins of melamine-formaldehyde, urea-formaldehyde, and diallyl orthophthalate-phenol, and the like. In addition to forming a thin film, the polymeric material should be capable of accepting wax or other heat-sensitive fusible material commonly used on transfer sheets. Additionally, the polymeric material should be relatively non-distortable at thermographic temperatures. The choice of material can best be made on the basis of well known properties, and where not know, can be readily determined. For further description of polymers which may be utilized herein, reference can be made to Modern Plastics Encyclopedia, McGraw-Hill, Inc., (1968) herein incorporated by reference.

Optionally, a plasticizer may be utilized in conjunction with the polymeric material, plasticizing amounts generally ranging between 25 and 100 percent by weight of the polymer. Suitable plasticizers include tricresyl phosphate, tri(2-ethylhexyl) phosphate, dioctylphthalate, di(2-ethylhexyl)tretrahydrophthalate, di(2-ethylhexyl)maleate, polyethylene glycol, and the like.

As carrier, one can utilize any appropriate solubilizing material with or without diluent which is sufficiently volatile to form a solid film in reasonable time. Suitable materials include xylene, dimethylformamide, acetone, toluene, methyl alcohol, tetrahydrofurane, ethyl alcohol, ethyl acetate, methylene dichloride, ethyl ether, methyl isobutyl ketone, butyl carbitol, butyl cellosolve acetate, dimethyl sulfoxide, and the like, or mixtures thereof.

The coating is formed under conditions which ordinarily would be avoided in the preparation of a smooth plastic film. Thus, the coating is formed under relatively high humidity conditions, in particular under ambient conditions of 50–75 percent relative humidity. Under these conditions, continued rapid curing and escape of solvent sets up shrinkage stresses and strains that cause the film to wrinkle. Films produced under the aforementioned conditions have a reticulated cellular surface structure with the cells having diameters distributed within the size range hereinbefore stated. Upon filling the cells with transfer material, e.g., as hereinabove described, carbon sites or regions are provided having the desired size distribution and range.

Coating under high humidity conditions is only one method of obtaining the required reticulation which can also be obtained by proper choice of solvent and drying temperature with respect to a particular polymeric material. With some combinations, reticulation can be obtained repeatedly without high humidity, while in other cases no practical control is possible without highly humid ambient conditions. Furthermore, with many polymers, such as polyvinyl chloride, a reticulated structure suitable for use herein can be obtained if the otherwise smooth polymer is contacted soon after coating with a non-solvent liquid such as water. For further methods of forming a textured coating, see "Organic Coatings" by A. G. Roberts, Building Science Series 7, February 1968, published by the U.S. Department of Commerce (National Bureau of Standards) incorporated herein by reference.

In accordance with a further embodiment herein, inorganic particulate material can be added to the organic polymeric material prior to formation of the coating. The particulate material is chosen simply on the basis of providing a textured coating, rather than for any absorption or adsorption characteristics. Suitable particulate materials are the clays, notably the silicate pigments, such as kaolin and components thereof such as kaolinite. Other materials include alumina, titania, silica, magnesia, and the like. In general, a particle size distribution between about 0.1 to about 25 microns is preferred. For example, Kaolinite UF, produced by the Georgia Kaolin Co., has a particle size distribution from about 1 micron down to less than 0.1 micron with an average particle size of about 0.2 micron.

Referring to FIGS. 3 and 4, there are schematically illustratred an alternative method of providing a transfer sheet with a discontinuous surface of discrete carbon regions. In this embodiment, the surface of the transfer sheet substrate is printed with a pattern of transfer material, the pattern comprised of varying sized regions, e.g. in a specific example there are regions 36 of about 3 microns units, regions 38 of about 10 micron units, regions 40 of about 15 micron units and regions 42 of about 25 micron units, the total surface area being divided about equally among the four size units. Printing can be accomplished with rollers bearing an intaglio image of the desired design. Other coating methods can also be used.

The amount of infrared radiation employed in using the transfer sheet in a sandwich assembly, as described with respect to FIG. 1, is substantially the same as used with usual spirit duplication processes. The usual exposure devices have various settings to enable a choice of exposure time as determined by the user after a trial run. The same procedures can be followed with the present transfer sheet although care should be taken not to overexpose so as to obtain the fullest advantage of the tone reproducing capability of the transfer sheet.

The following example will further illustrate the invention.

EXAMPLE

Thirty grams of polyvinyl chloride are dissolved in 200 milliliters of a solvent blend of a xylene dimethyformamide (2:1 parts by volume). The solution is ball-milled for 15 hours and then applied to a 1 mil sheet of Mylar. A Bird coating bar is used to apply the solution so as to obtain a dry coating thickness of 0.5 mil. The coating is dried under 50–75 percent relative humidity conditions with the result that the dried surface is reticulated.

The coated sheet is then placed with its reticulated surface in contact with the dye-wax mixture of a transfer sheet sold by Bell & Howell Company under the trademark "Ditto Fax Master", type C4 having a "carbon" layer 0.4–0.5 mil thick. The sandwiched assembly is heated with infrared light until fusion and transfer of the carbon material to the reticulated sheet. After separation, the reticulated sheet has the appearance schematically portrayed in FIG. 2.

The coated reticulated sheet is then placed in face-contact with a sheet of Mylar and assembled as in FIG. 1 with a photographic original. The assembly is then inserted into a spirit process exposure and printing unit sold by Bell & Howell Company under the trademark "Ditto Combomatic". Exposure is made at a setting of 7.5 (low of 10, high of 1) to obtain a master sheet showing intermediate tones. The master sheet can be used in the usual manner to produce a plurality of copies having such intermediate tones.

We claim:

1. In the combination of a transfer sheet comprising a substrate and a thermally transferable heat-sensitive material thereon, and a master sheet for receiving said heat-sensitive material by thermal transfer from said transfer sheet, the improvement wherein said heat-sensitive material is in the form of a discontinuous layer defined by a substantially uniform distribution of a plurality of closely spaced discrete regions.

2. The improvement of claim 1 in which said discrete regions are of varying widths.

3. The improvement of claim 1 in which said regions have an average diameter of about 1 micron to about 30 microns, the distance between carbon regions being from about 0.1 micron to about 30 microns.

4. The improvement of claim 3 in which about 25–75 percent of the total surface area of said layer is constituted by carbon regions having an average diameter of about 11–30 microns, the remainder having average diameters of about 1–10 microns.

5. A transfer sheet for use in a thermal transfer process for reproducing a thermally detectable original image, comprising a substrate and a discontinuous layer thereon in the form of a pattern of a plurality of closely spaced discrete carbon regions of thermally transferable heat-sensitive material of varying widths substantially uniformly distributed over said substrate whereby to enable transfer of said heat-sensitive material temperature correlated with the optical density of said original image.

6. The transfer sheet of claim 5 in which said regions have an average diameter of about 1 micron to about 30 microns, the distance between carbon regions being from about 0.1 micron to about 30 microns.

7. A transfer sheet for use in a thermal transfer process for reproducing a thermally detectable original image, comprising a substrate and a discontinuous layer thereon in the form of a pattern of a plurality of closely spaced discrete regions of thermally transferably heat-sensitive material of varying widths substantially uniformly distributed over said substrate whereby to enable transfer of said heat-sensitive material temperature correlated with the optical density of said original image, about 25–75 percent of the total surface area of said layer being constituted by carbon regions having an average diameter of about 11–30 microns, the remainder having average diameters of about 1–10 microns.

* * * * *